US005684438A

United States Patent [19]

Cavalieri D'Oro et al.

[11] Patent Number: 5,684,438

[45] Date of Patent: Nov. 4, 1997

[54] MICROWAVE FILTER INCLUDING A PLURALITY OF CROSS-COUPLED DIELECTRIC RESONATORS

[75] Inventors: Enzo Cavalieri D'Oro, Monza; Luca Ferrari, Concorezzo; Giuseppe Resnati, Seregno; Renato Zocca, Brugherio, all of Italy

[73] Assignee: Forem, S.p.A., Italy

[21] Appl. No.: 492,747

[22] Filed: Jun. 21, 1995

[51] Int. Cl.[6] ..... H01P 1/20

[52] U.S. Cl. ..... 333/202; 333/219.1; 333/230

[58] Field of Search ..... 333/202, 203, 333/208, 209, 212, 219.1, 230, 202 DR

[56] References Cited

U.S. PATENT DOCUMENTS

| | | | |
|---|---|---|---|
| 4,453,146 | 6/1984 | Fiedziuszko | 333/230 X |
| 4,890,078 | 12/1989 | Radcliffe | 333/203 X |

FOREIGN PATENT DOCUMENTS

| | | | |
|---|---|---|---|
| 136301 | 6/1986 | Japan | 333/202 DR |
| 299602 | 12/1988 | Japan | 333/219.1 |
| 6085504 | 3/1994 | Japan | 333/202 DR |

*Primary Examiner*—Benny Lee

[57] ABSTRACT

A power microwave band-pass filter having very high quality factor (i.e., very low insertion loss) and selectivity, includes a cover and a body with dielectric resonator containing cavities. Non-adjacent cavities are cross-coupled by trapezoidal shaped bridging elements, at least one of which is associated with the cover and at least one of which is associated with the filter body. Each bridging element is penetrated in a slit of an electrically insulating holder placed in a knot of two non-adjacent cavities. The bridge element associated with the cover is grounded and acts inductively while the bridge element associated with the filter body is not grounded and acts capacitively.

11 Claims, 7 Drawing Sheets

CF
P1
f1
L1
B
2
1
D2
D1
P2
P4
f2
SC1-3
AL1
AL2
Z2
I1
Z1
B1
L2
4
VA1
S
D4
D3
f4
3
SC4-6
AL4
AL3
Z4
f3
B2
Z3
I2
VA2
5
A
A
D6
D5
6
B
P3
PS
OC
L3
f5
CO

MICROWAVE FILTER INCLUDING A PLURALITY OF CROSS-COUPLED DIELECTRIC RESONATORS

BACK GROUND OF THE INVENTION

1. Field of the invention

The present invention concerns microwave filters comprising several cavities each housing a dielectric resonator and characterized by high quality coefficient (Q), low insertion loss, high selectivity etc. and consisting of a basic parallelepiped body having side walls which determine, in cooperation with at least one longitudinal wall and at least one transversal wall, the dielectric resonator containing cavities, the cavities forming a body being open to its top where it is closed by a cover.

2. Description of the Related Art

It is known that in mobile radio systems, it is extremely necessary to have filters showing very high quality factors, e.g. in the order of 20–22,000, low loss, very narrow passing band and transmission zero points.

Among the power filters able to satisfy these requirements are dielectric filters; however the advantage of the high performances of these dielectric filters is accompanied by the disadvantage that the field, especially the electric field, is concentrated within the resonators whereby it is not easy to extract the field of one cavity to couple it with that of a non-adjacent cavity and to obtain couplings with transmission zeroes Knowingly the near and adjacent cavities can be coupled through an adequate opening in the wall common to the two cavities.

For the cross-coupling of the non-adjacent cavities in the filters without dielectric resonators, various types of bridges are currently used, mainly of the capacitive and inductive types (f.i. loops or feelers . . . ) which are however not applicable to the cross-coupling between the fields of the dielectric resonators cavities.

SUMMARY OF THE INVENTION

The object of the present invention is to provide a band pass filter of high frequency signals, in particular power filter of microwaves, having very high quality factor, i.e. very low insertion loss, high selectivity and transmission zeroes, and consisting of:

- a filter body (CF) in which several cavities (1, 2, 3, . . . 6 . . . ) are formed;
- dielectric resonators (D1, D2, D3 . . . D6 . . . ) housed in said cavities;
- input and output connectors in said filter body;
- a cover (CO) of closure of said filter body with dielectric resonator containing cavities;
- screw stems projecting from the inner surface of said cover and extending inside said filter body;
- plates or discs (DIS) facing but at a distance from the top surface of said resonators, and associated to the ends of screw stems which regulate said distance and, accordingly, the tuning or band central frequency (Fo) of the filter;
- apertures or openings in the walls of near and adjacent cavities to have a cross-coupling therebetween;
- screw-stems penetrating with their free ends within the openings to control the cross-coupling between adjacent cavities;
- screw on the outer surface of the cover to displace the tuning regulating stems as well as said stem ends associated and penetrating in said openings of common contiguous cavity walls; and means to cross-couple the remaining non-adjacent cavities.

According to the main feature to the invention non-adjacent cavities are now cross-coupled in such a way to further reduce the already low insertion losses, typical of the dielectric resonators. More particularly the invention concerns a system comprising at least two bridges, one of which provides the coupling between non-adjacent (for instance, unpaired) cavities, is of a capacitive nature and is associated with the filter body, whereas the other bridge provides the cross-coupling between (for instance, paired) cavities, is of an inductive nature and is associated with the filter cover or cap. Because of the combination of these two bridges, it is possible to obtain an advantageous wider pass-band (to reduce the losses) and to impart higher steepness to the fronts delimiting such a band, namely to have, out of the band, extremely high attenuation values in correspondence to such fronts and thus to realize adequate transmission zeros.

Advantageously in the openings coupling adjacent cavities a cylindrical enlarged head at the free end of a pin projecting from the inner surface of the cover is vertically slided by operating a screw placed on the outer face of said cover, said pin with enlarged head being typically totally metallic.

The main features of the filter according to the invention are recited in the claims.

BRIEF DESCRIPTION OF THE DRAWINGS

The various aspects and advantages of the invention will be appreciated from the following description of the preferred embodiment shown in the accompanying drawings in which.

DETAILED DESCRIPTION OF THE PREFERRED EMBODIMENT

For an easy understanding of the invention, reference is made to the embodiment particularly simple of the six-cavities filter shown emblematically (and unlimitedly) in the accompanying drawings.

Figure 1:
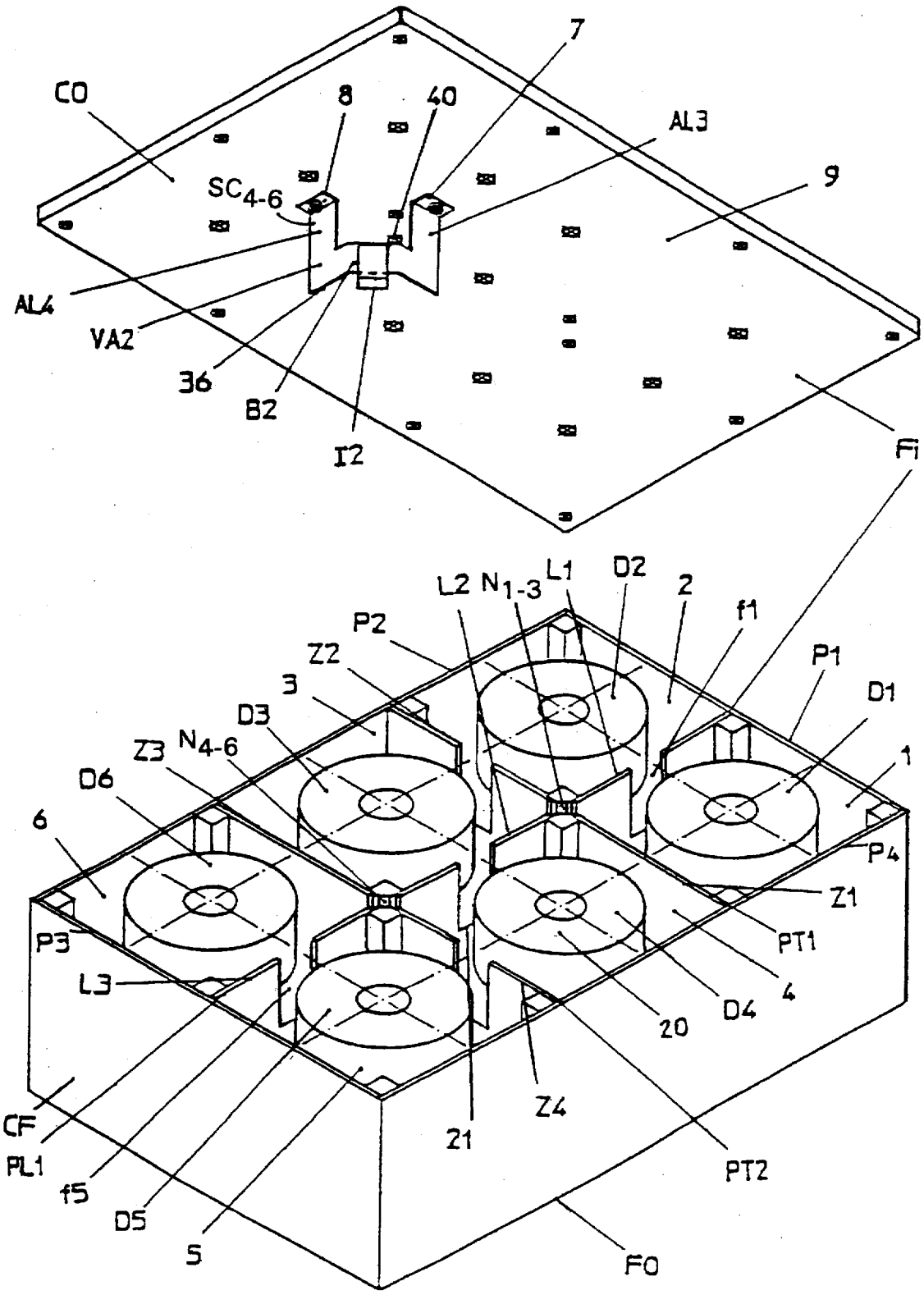
FIG. 1 is a perspective representation of the filter FI according to the invention.
Figure 2:
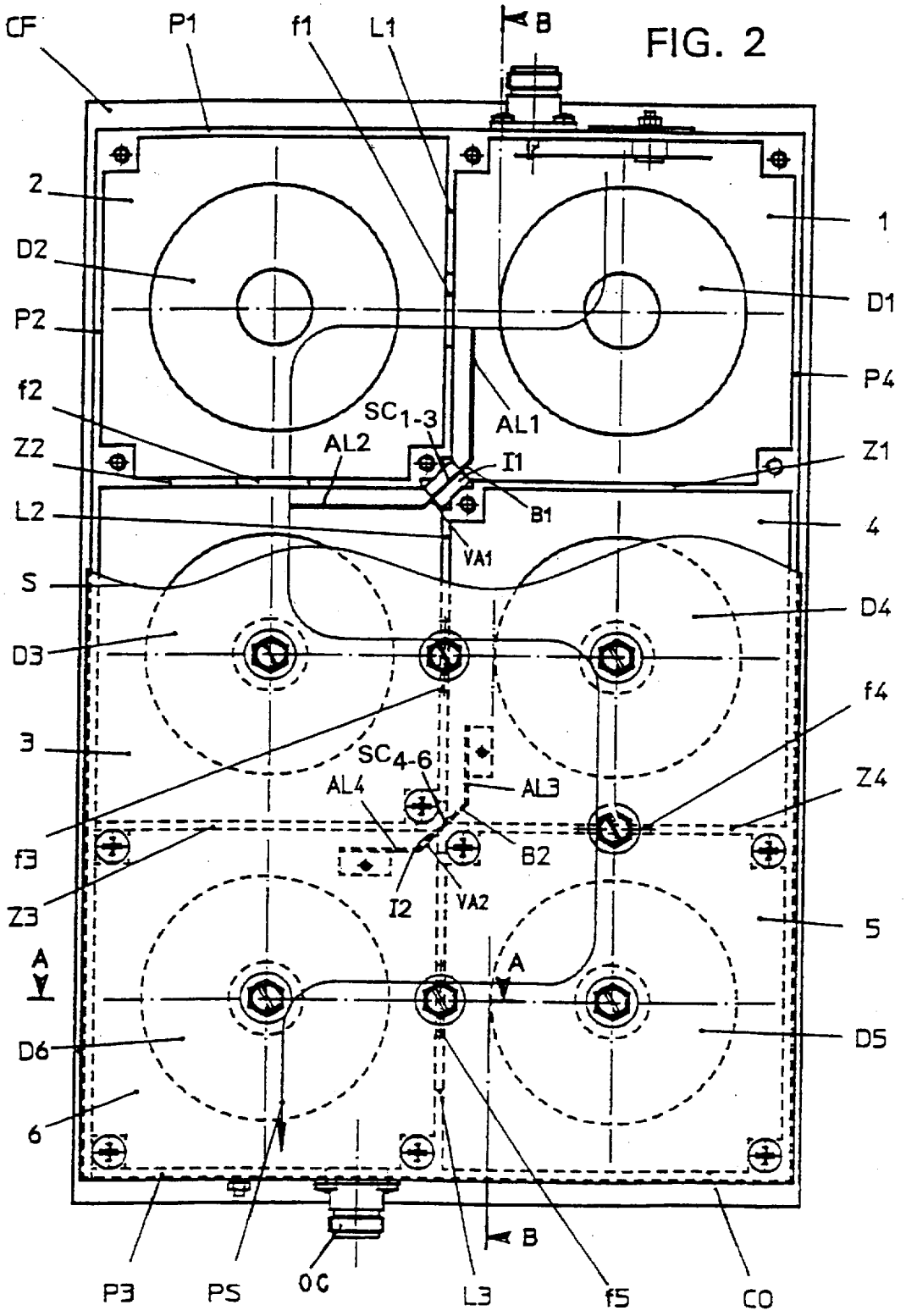
FIG. 2 is a top view of the body CF of said filter having the cover cut along the line S.
Figure 3:
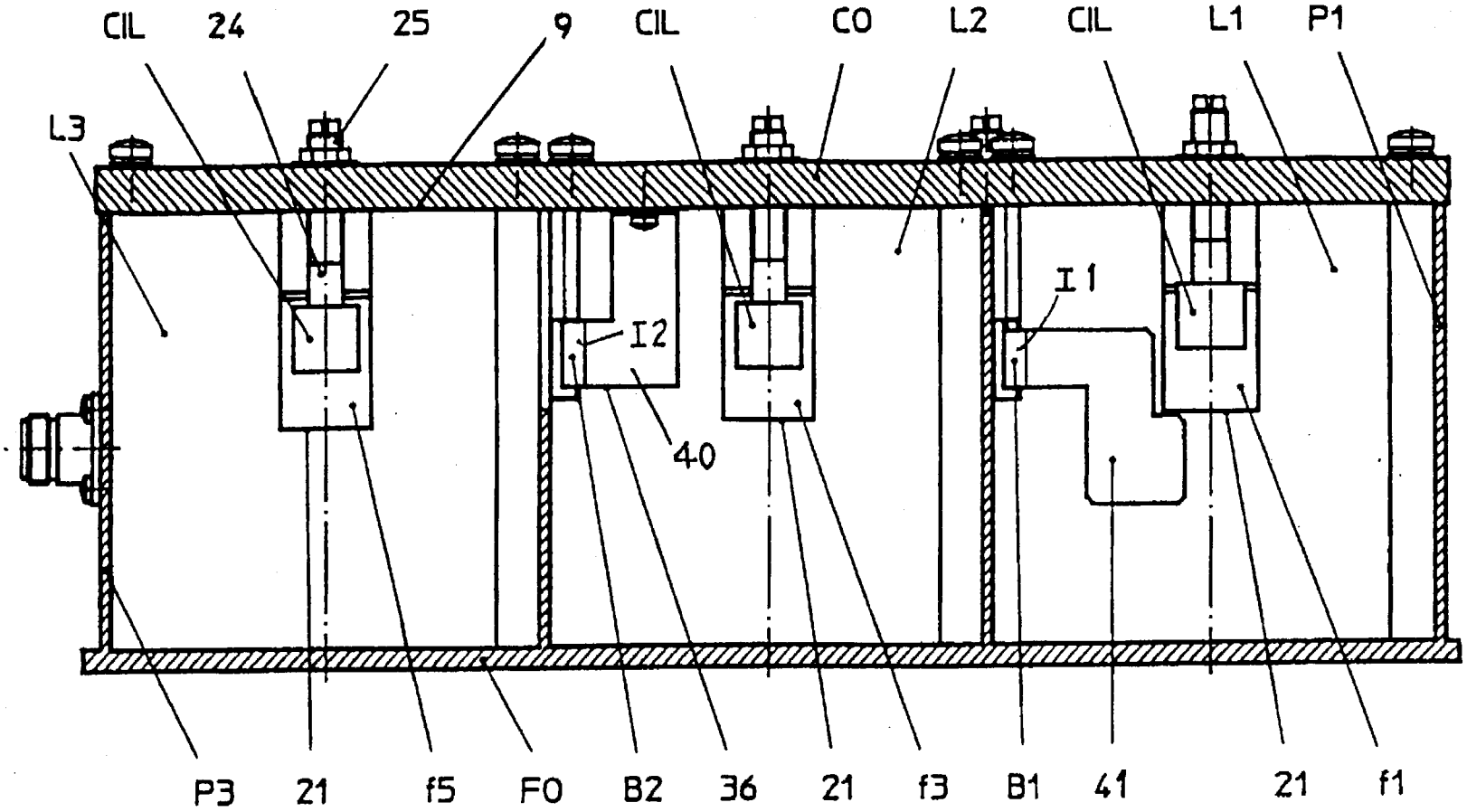
FIG. 3 is a cross-section along the line B—B on FIG. 2.

In the FIGS. 1–4, F1 indicates the filter comprising a filter body CF and a cover CO. The body CF can be formed by four outer walls, two longitudinal walls P2 and P4 as shown in FIGS. 1 and 2, and two transversal walls P1 and P3, as shown in FIGS. 1–3. The six cavities 1, 2, 3, 4, 5 and 6, each containing a dielectric resonator D1, D2, D3, D4, D5 and D6 (FIG. 1) are obtained, for example, by introducing inside the body CF two inner transversal walls PT1 and PT2 and one inner central longitudinal wall PL1. This last wall PL1 divides the transversal walls PT1 and PT2 in four sections Z1, Z2, Z3 and Z4 and is (imaginarily) divided in three sections L1, L2 and L3 (FIG. 1). The partial walls L1, Z2, Z4 and L3 are provided with openings f1, f2, f3, f4 and f5

(FIGS. 2–4) which define the path (line PS) (FIG. 2) of the signals within the body CF from the input connector IC to the output connector OC as well as the adjacent pairs of cavities along said path i.e. 1-2, 3-4 and 5-6 (FIG. 2).

In the embodiment shown in pairs of cavities, for instance FIGS. 1–4, only the FIGS. 1–3 and 4–6 remain non-adjacent (along and in the direction of path PS).

Known in the prior art are couplings between non-adjacent cavities without dielectric resonators, which are realized with simple piercing means like inductive-capacitive bridges, for example, in the form of loops and feeders.

When, as in this case of powerful dielectric resonators D1–D6, conventional bridges cannot be used mainly because the electric field in each cavity is substantially confined inside each dielectric resonator whereby recourse is to be made to spillage means entirely new and surprising as those according to the invention.

According to a first feature of the invention, the step-overs (FIGS. 1 and 2) or bridges are preferably made of metallic sheets or laminae in the form of top-open trapeziums or of a counter-sunk "tray" VA1, VA2 respectively of the base B1 (FIGS. 2 and 3) and B2, respectively, of each "tray" introduced in the node of not-contiguous cavities N1-3 (FIGS. 1 and 2), B4-6 (FIG. 1), respectively, and with the lateral tray wings AL1, AL3, and AL4, AL6, respectively placed parallel to the two walls L1 and Z2, L2 and Z3 (perpendicular to each other), respectively, of the non-adjacent cavities (FIG. 1).

According to an other feature of the invention, the bases B1 and B2 and wings A11 and A12 are very wide (FIGS. 5 and 6*a*), and thus create a strong cross-coupling between non-adjacent resonators.

According to an other feature of the invention, a bridge element (FIG. 2), for instance $SC_{1-3}$) is placed on the filter body CF, penetrates with its base B1 within a holder or support of insulating material I1 having a slit open on top but closed on the bottom, placed in the knot N1-3, whereby said subport I1 isolates the bridge element $SC_{1-3}$ from the bottom wall FO of the filter body CF, and inhibits its grounding (FIGS. 2 and 3). The bridge element $SC_{1-3}$ forms thus a capacitive cross-coupling.

The second bridge element $SC_{4-6}$ is associated with the cover CO, is fixed to the inner wall 9 of the element cover through two turn-ups 7 and 8, penetrates with its base B2 into the slit (open on top and closed at the bottom) of an insulating holder I2 (FIG. 2) inserted in the node (FIG. 1). The bridge element $SC_{4-6}$ grounded through the inner face 9 of the cover CO and is thus of the inductive type (FIG. 1).

According to a further feature of the invention, each window f1, f2, f3, f4 and f5 in the corresponding wall L1, Z2, L2, Z4 and L3 has an height extending from the lower threshold 21 up to the wall roof-ridge i.e. up to the lower face of the cover; typically the lower threshold of the window opening 21 (FIGS. 3 and 4) is at a level lower than the top 20 (FIG. 4) of each dielectric resonator. Characteristically, in each window opening (coupling adjacent cavities) having a height from the threshold 21 up to the inner face 9 (FIGS. 1 and 3) of the cover CO, penetrates a metallic cylindrical head CIL which is at the free end of a pin 24 (having a diameter lower than the diameter of CIL) which is moved by the screw 25 to vary penetration of pin 24 to in a minor or major measure within the relevant window opening to therefore vary the cross-coupling between contiguous cavities. Advantageously the penetration complex CIL-22-24 (FIG. 3) is entirely metallic (instead of the conventional pin held by a compulsory ceramic stem).

Figure 5:
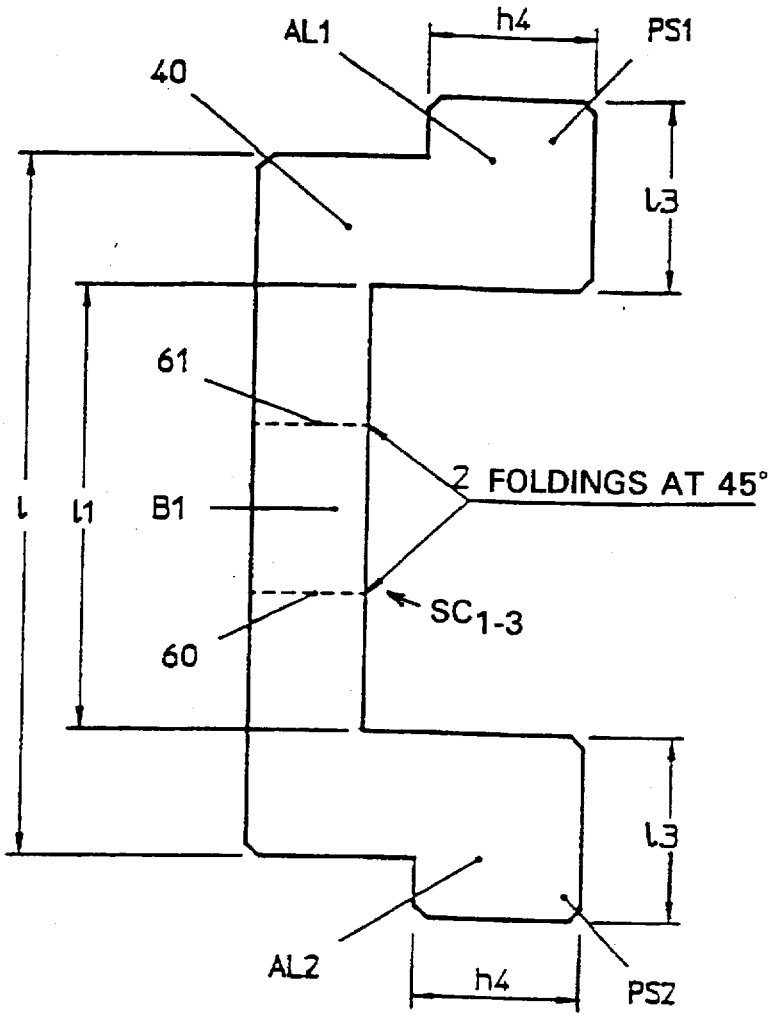
FIGS. 5, 5*a*, 5*b* and 6, 6*a*, 6*b* and 6*c* show some simple modes to make the bridges in form of a tray starting from thin metallic sheets or laminas so sized to produce optimal coupling with the dielectric resonators.
Figure 6:
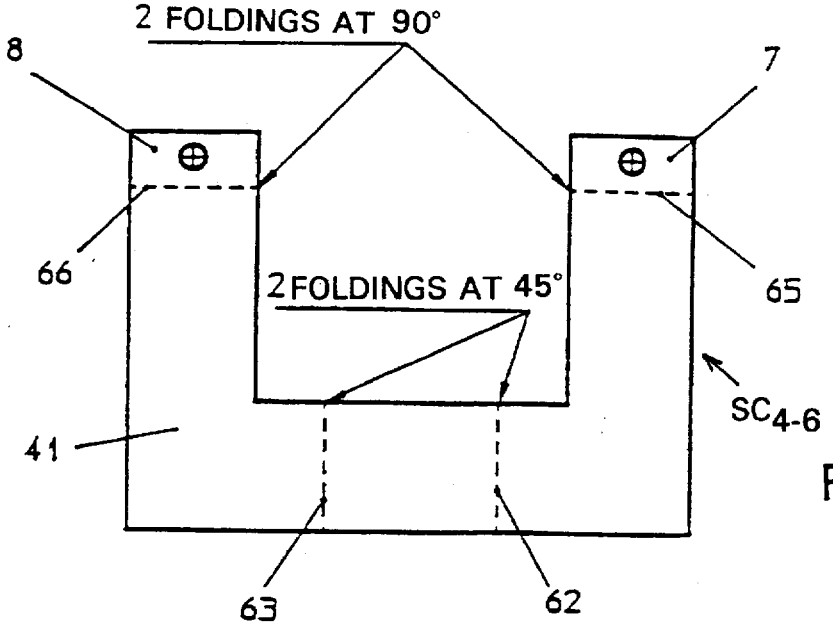

FIGS. 5 and 6 are top views of sheets or laminae 40-41 starting from which are obtained the bridge (step-over) element $SC_{1-3}$ and $SC_{4-6}$, respectively which, as above stated, must provide the highest cross-coupling with the relevant dielectric resonators. The bridge element $SC_{1-3}$ has two wings AL1 and AL2 (FIG. 5) which couple resonators D1 and D3, and is obtained from the thin plate 40 (FIG. 5) having the central sector or base B1 to connect said wings.

These wings AL1 and AL2 create a very high capacitive coupling through their blunted ramifications PS1, PS2 (FIG. 5). The length "1" between said blunted descendants, the length "13" thereof with the relevant height "h4" are critical in the sense that their dimensions define the frequency Fs in correspondence of which a transmission zero is obtained, said frequency Fs being higher than the filter central frequency Fo.

Figure 5A:
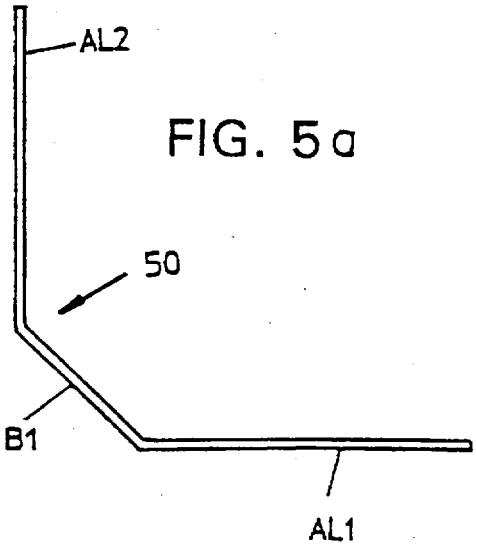
Figure 5B:
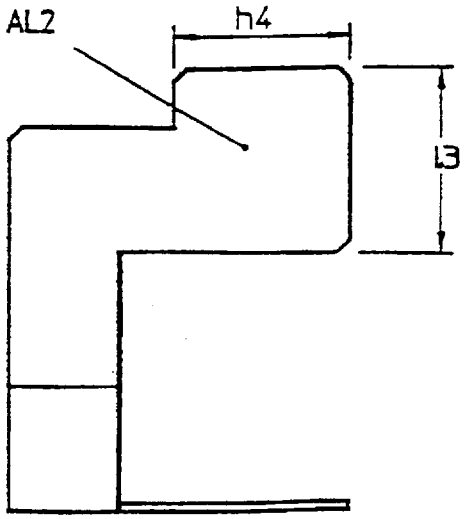

Advantageously the final structure of the bridge or step-over $SC_{1-3}$ as represented in the top view of FIG. 5*a* and in the view along the arrow 50 in FIG. 5*b* is reached with two simple bendings or foldings along the lines 60 and 61 (FIG. 5).

Figure 6C:
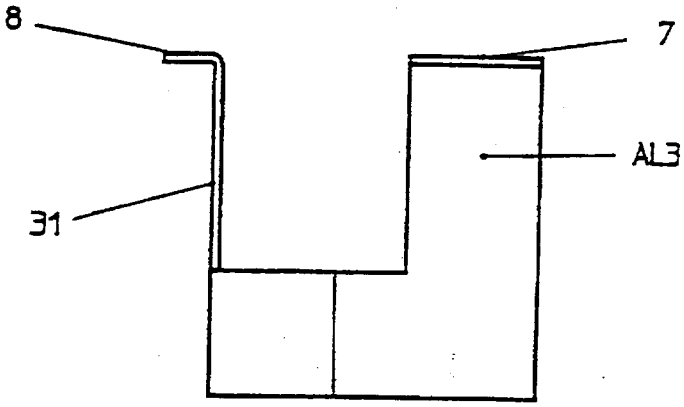
Figure 6A:
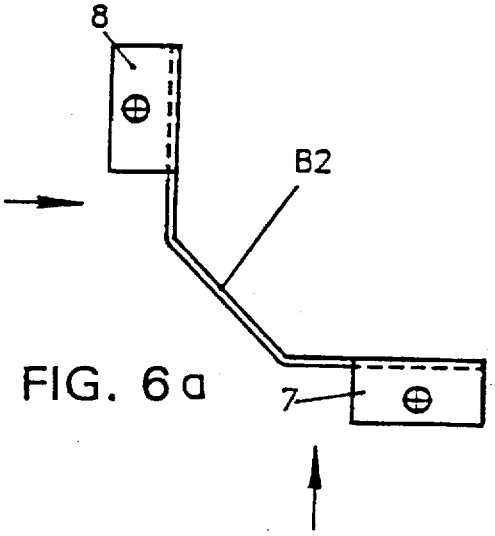
Figure 6B:
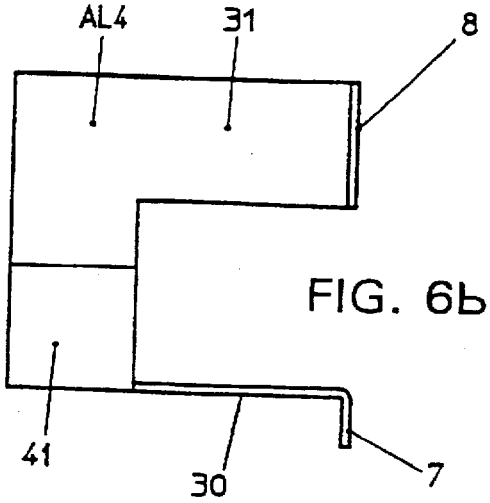

In the slightly more complex case of bridge element $SC_{4-6}$ which is to be attached, such as by soldering, to the inner surface, of cover CO by means of the turn-ups 7 and 8 (FIG. 2), foldings 62 and 63 (FIG. 6) are made as in the case of $SC_{1-3}$ (FIGS. 5*a*, 5*b*) but in addition also bendings 65 and 66 (FIG. 6*c*) are carried out to obtain said turn-ups 7 and 8.

Other equivalent systems of folding thin metallic sheets or plates can be used also according to the available bending apparatus. As in the case of $SC_{1-3}$ of FIGS. 5, also the starting lamina 41 for the bridge element $SC_{4-6}$ of FIG. 6 must have total extensions of lengths and wideness of its ramifications AL3–AL4 (FIGS. 6 and 6*c*) such to critically determine the other zero transmission frequency Fi falling below said filter central frequency Fo.

In this description the form of the bridge elements $SC_{1-3}$ and $SC_{4-6}$ has been defined as the form of a "tray" or open trapezium just for illustrative semplicity: indeed in the FIGS. 1, 2, 5 and 6 the bridges look roughly like open trays, (or trapezium without the major base) i.e. bodies substantially U-formed. A further difference between $SC_{1-3}$ and $SC_{4-6}$ is in their disposition in the sense that tray $SC_{4-6}$ (FIG. 1) has the base or bottom B2 in the lowest position (FIG. 3) whereas the tray of $SC_{1-3}$ is overturned and has thus the base B1 up-wards (FIG. 3).

Figure 4:
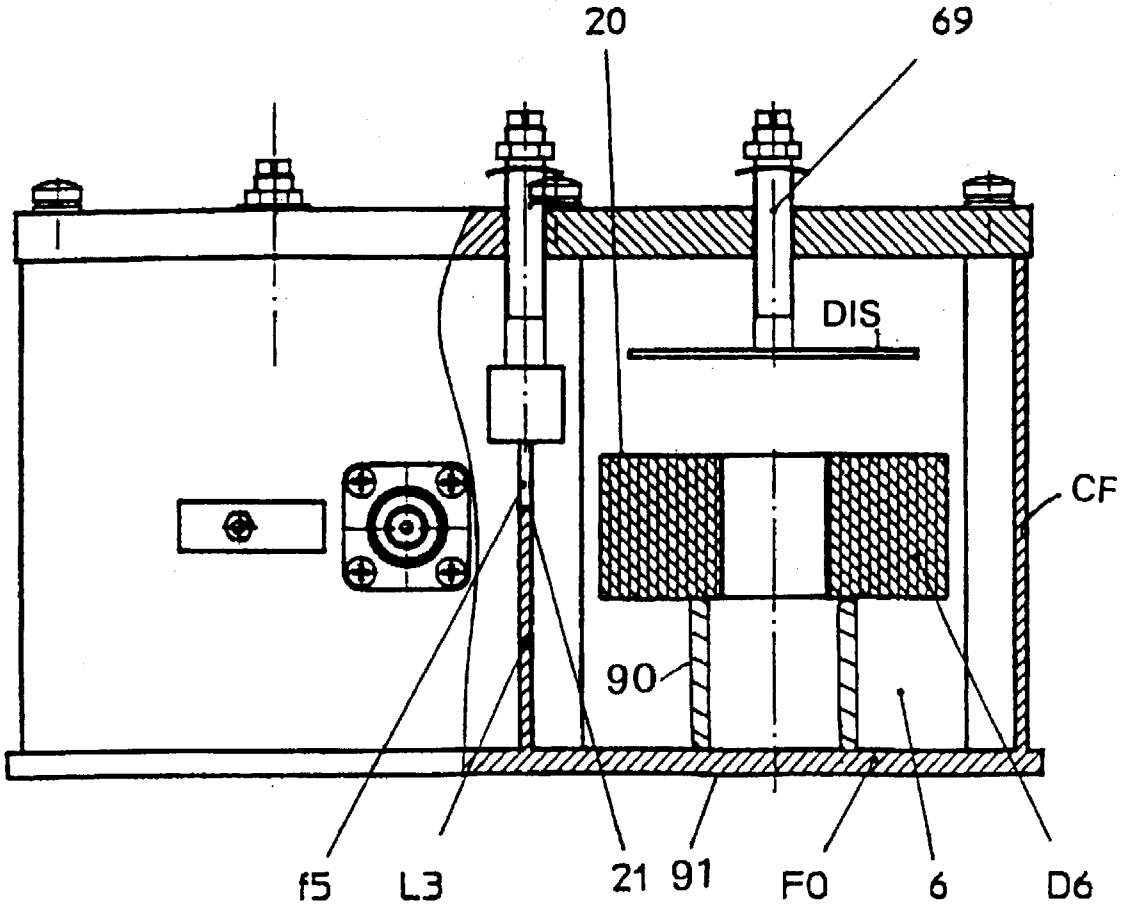
FIG. 4 is the cross-section along line A—A also on FIG. 2.

In FIG. 4 cavity 6 containing dielectric resonator D6 is shown as being a hollow cylinder CC of dielectric material held stationary by support 90 fixed to the bottom of the filter body CF. The tuning of the cavities is carried out by desplacing upwards or downwards the metallic plate or disc DIS with the aid of the tuning screw 69.

Figure 7:
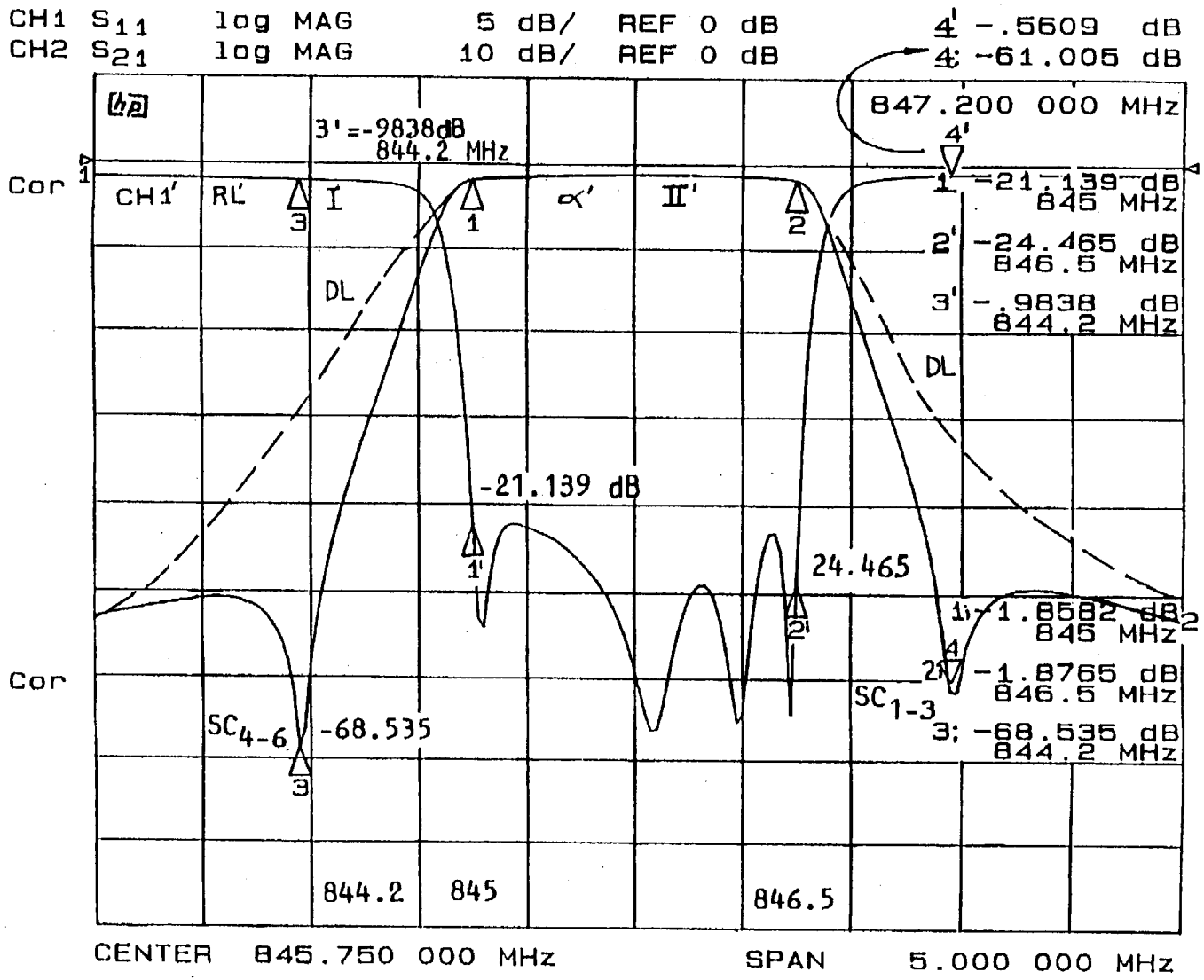
FIG. 7 is the characteristic response of a filter of the invention.

Obviously other (per se known) embodiments of tuning systems can be adopted. In the characteristic response of a filter of the invention of FIG. 7, (as depicted on a Hewlett and Park computer) channel $CH_1$ (I) ($S_{11}$) gives the return loss RL and $CH_2$ ($S_{2-1}$) gives the attenuation ($\alpha$). The central frequency (center is 845.7500 MHz, while the span is of 5.000.000 MHz). the dotted lines DL show how the alternation of final curve (II) ($S_{2-1}$) would increase very slowly in the absence of the capacitive ($SC_{1-3}$)- and inductive ($SC_{4-6}$)- bridges.

The marker points 1 and 2 define the pass-band from 845 to 846.5 MHz with attenuation values of −1.8582 dB in marker 1, and of −1.8765 dB in marker 2. Inductive bridge $SC_{4-6}$ jump the low attenuation (−1.8582, at 854 dB) in marker 1 to the very high value in marker 3 (−68.535 dB) at 844.2 MHz; accordingly the attenuation jump occurs in the very small frequency interval from 844.2 to 845 MHz. At the other end of the band (marker 2) the action of the capacitive bridge $SC_{1-3}$ boosts the attenuation from −1.8765 db (at 846.5 MHz in said marker 2) to the very high attenuation value (in marker 4) of −61.005 dB at 847.200 MHz. It may thus be seen that the attenuation jump occurs in very narrow frequency gaps.

A further advantage is that the curve $CH_1$ of the return loss RL shows optimal values in markers 1' and 2' in correspondence of markers 1 and 2 of the attenuation curve. The optimal values of the return loss in 1' (starting from marker 3') is obtained by acting on the tuning regulation of the resonators through the desplacement of the disc DIS with the aid of the tuning screw −69. On the other hand the optimal value of the return loss in marker 2' is advantageously obtained by acting on the penetration of the cylindrical head CIL at the end of pins 24 within the openings f1, f2–f5.

These two means namely the head CIL and the tuning screw (69) (moving the disc DIS) allow the obtainement of very good return loss curve in correspondence of the optimal attenuation curve, during the general setting of the filter. A double optimal performance (i.e. a high quality filter) is so obtained.

We claim:

1. A band pass filter for high frequency signals, said filter having a very high quality factor, high selectivity and transmission zeroes, the filter comprising:

a filter body having several cavities:

respective dielectric resonators housed in corresponding ones of said several cavities;

and output connectors in said filter body;

a cover on said filter body;

screw stems projecting from an inner surface of said cover and extending inside said filter body;

respective plates facing but at respective distances from a top surface of corresponding ones of said dielectric resonators, and attached to respective ones of said screw stems which regulate said respective distance and, thereby the tuning frequency of the filter;

walls of adjacent cavities having openings therein to provide a cross-coupling therebetween;

control elements having free ends, and the free ends of the control elements penetrating within respective ones of said openings to control said cross-coupling between adjacent ones of said cavities;

adjusting elements on an outer surface of said cover to displace respective tuning regulating stems, as well as respective stem ends associated with and extending in said corresponding, openings between adjacent cavity walls; and means to cross-couple non-adjacent cavities, wherein each said non-adjacent cavity cross-coupling means includes a respective bridge element having a base which penetrates and rests in a slit of an electrically insulated holder disposed in a corresponding node between non-adjacent cavities, and said respective bridge element having corresponding wings which are disposed in positions of optimal coupling with the dielectric resonators associated therewith, at least one of said respective bridge elements being conductively connected to the filter cover, whereas an other one of respective bridge element being associated with the filter body from which it is electrically insulated.

2. Filter according to claim 1, wherein each one of the bridge elements are comprised of a corresponding thin highly conductive metallic sheet and the respective bases and the corresponding wings thereof have large coupling surfaces.

3. Filter according to claim 1, wherein at least one of said bridge elements is displaced with respect to at least an other bridge element in the sense that said displaced bridge element assumes a position whereby said at least one bridge element has the base thereof at a position higher than that of ends of corresponding wings while the other bridge element has the base thereof at a level lower than the level of free ends of corresponding wings.

4. Filter according to claim 3, wherein free ends of the wings of one of said bridge elements have elements turned up to fix said bridge element to the inner surface of the filter cover.

5. Filter according to claim 3, wherein a bridge element is a capacitive bridge element the capacitive bridge is held amovably in an elastic slit of an insulating holder placed in the node of non-adjacent cavities, the base and the lateral walls of the tray having no contact with the body filter bottom and with the outer walls of the non-adjacent cavities.

6. Filter according to claim 1, wherein the filter body includes four outer lateral walls, at least an inner central longitudinal partition wall and at least two inner transversal partition walls, the internal partition walls have openings which successively define the path of the signals within the filter from an input thereat to an output thereof, and each has an opening with a threshold at a level lower than the level of the dielectric resonator top, a coupling of said opening being controlled by the penetration of an enlarged head of the control element protruding internally from the cover carrying a screw for regulation of said penetration, said pin and said enlarged head being metallic.

7. Filter according to claim 1, wherein one of said bridge elements is a capacitive bridge element, the capacitive bridge element is held amovably in an elastic slit of an insulating holder placed in the node of non-adjacent cavities, the base and the wings of the capacitive bridge element having no contact with a bottom of the body filter and with the outer walls of the non-adjacent cavities.

8. Filter according to claim 1, wherein said control elements are screw-stems.

9. Filter according to claim 1, wherein said control elements are pins.

10. Filter according to claim 1, wherein said bridge element is, in cross-section, substantially the form of a counter-sunk tray.

11. Filter according to claim 1, wherein said bridge element is, in cross-section, substantially the form of a top-open trapezium.

* * * * *